US008066037B2

(12) United States Patent
Lawrence et al.

(10) Patent No.: US 8,066,037 B2
(45) Date of Patent: Nov. 29, 2011

(54) DRIPLESS NOZZLE

(75) Inventors: James L. Lawrence, Wilson, NC (US); Charles S. Pearson, Wilson, NC (US); Didier Kaczmarek, Rocky Mount, NC (US)

(73) Assignee: EMCO Wheaton Retail Corporation, Wilson, NC (US)

( * ) Notice: Subject to any disclaimer, the term of this patent is extended or adjusted under 35 U.S.C. 154(b) by 648 days.

(21) Appl. No.: 12/219,794

(22) Filed: Jul. 29, 2008

(65) Prior Publication Data

US 2009/0050233 A1 Feb. 26, 2009

Related U.S. Application Data

(63) Continuation-in-part of application No. 11/798,509, filed on May 15, 2007, now Pat. No. 7,735,529, which is a continuation of application No. 11/328,188, filed on Jan. 10, 2006, now Pat. No. 7,216,680, which is a continuation of application No. 10/882,639, filed on Jul. 2, 2004, now Pat. No. 6,983,772.

(51) Int. Cl.
*B65B 1/04* (2006.01)

(52) U.S. Cl. ..... 141/311 A; 141/392; 222/571; 137/312

(58) Field of Classification Search ..... 141/206–229, 141/311 A, 392; 222/571; 137/312
See application file for complete search history.

(56) References Cited

U.S. PATENT DOCUMENTS

| | | | |
|---|---|---|---|
| 573,759 | A | 12/1896 | Brown |
| 1,357,629 | A | 11/1920 | Faistl et al. |
| 4,113,153 | A | 9/1978 | Wellman |
| 4,214,614 | A | 7/1980 | Pyle |
| D307,115 | S | 4/1990 | Waymack |
| 5,000,360 | A | 3/1991 | Lown et al. |
| 5,067,639 | A | 11/1991 | Maguire et al. |
| 5,169,040 | A | 12/1992 | Wiley |
| 5,228,596 | A | 7/1993 | McNally |
| 5,377,729 | A | 1/1995 | Reep |
| 5,603,364 | A | 2/1997 | Kerssies |
| 5,620,031 | A | 4/1997 | Dalhart et al. |
| 5,620,032 | A | 4/1997 | Dame |
| 5,645,116 | A | 7/1997 | McDonald |
| 5,765,609 | A | 6/1998 | Dalhart et al. |
| 5,938,087 | A | 8/1999 | Randall |
| 6,349,860 | B1 | 2/2002 | McMahon et al. |
| 6,431,417 | B1 | 8/2002 | Kumar |
| 6,520,222 | B2 | 2/2003 | Carmack et al. |
| 6,835,223 | B2 | 12/2004 | Walker et al. |
| 6,854,491 | B1 | 2/2005 | Knight et al. |
| 6,941,984 | B2 | 9/2005 | Knight et al. |

(Continued)

*Primary Examiner* — Timothy L Maust

(74) *Attorney, Agent, or Firm* — Merek, Blackmon & Voorhees, LLC

(57) ABSTRACT

A nozzle for dispensing fuel into a vehicle having a body portion and a spout extending from the body portion. The spout passes fuel from the body portion to a vehicle during refueling. The body portion includes a fuel flow control member for allowing or preventing fuel from passing through the body portion and the spout. A fuel collector collects fuel remaining in the body portion and the spout after the fuel flow control member shuts-off the flow of fuel through the body portion and the spout. Preferably, the fuel collector is configured to allow fuel collected in the fuel collector when the vehicle is being refueled to drain into the fuel tank of the vehicle after the flow control member prevents fuel from passing through the body portion and the spout but prior to removal of the spout from the fuel tank of the vehicle.

18 Claims, 8 Drawing Sheets

U.S. PATENT DOCUMENTS 6,983,772 B1 1/2006 Lawrence et al.
7,036,536 B1 5/2006 Knight et al.
7,063,112 B2 6/2006 Fink et al.
7,216,680 B2 5/2007 Lawrence et al.
7,735,529 B2 * 6/2010 Lawrence et al. ..... 141/311 A
2005/0056340 A1 3/2005 Walker et al.

* cited by examiner

DRIPLESS NOZZLE

RELATED PATENT APPLICATIONS

The subject patent application is a continuation-in-part and claims priority under 35 USC §120 from U.S. patent application Ser. No. 11/798,509 filed on May 15, 2007, now U.S. Pat. No. 7,735,529, which in turn is a continuation of U.S. patent application Ser. No. 11/328,188 filed on Jan. 10, 2006, now U.S. Pat. No. 7,216,680, which in turn is a continuation of U.S. patent application Ser. No. 10/882,639 filed on Jul. 2, 2004, now U.S. Pat. No. 6,983,772. The entire contents of U.S. patent application Ser. Nos. 11/798,509; 11/328,188; and 10/882,639 are hereby incorporated by reference.

FIELD OF THE INVENTION

The present invention relates to fuel dispensing systems for dispensing fuel into a vehicle fuel tank. More particularly, the present invention relates to a dripless fuel dispensing nozzle for dispensing fuel into a vehicle fuel tank.

BACKGROUND OF THE INVENTION

Various nozzles have been proposed for use in fuel dispensing systems to transfer fuel from a storage tank to a vehicle fuel tank. Environmental and/or safety concerns have dictated that nozzles of a fuel dispensing system be designed to prevent fuel from dripping from the spout of the nozzle after the nozzle is removed from the vehicle fuel tank and returned to the dispenser.

U.S. Pat. Nos. 5,377,729; 5,645,116; 5,603,364; 5,620,032; and, 6,520,222 disclose various nozzle structures designed to prevent fuel from dripping from the spout once it is removed from a fuel tank. These designs have numerous inherent disadvantages. For example, a number of these prior designs require complex valves to prevent fuel from dripping from the end of the spout of the nozzle. These valves increase the cost and time to manufacture the nozzle. Further, these prior designs all include a relatively large obstruction centrally located in the channel or passageway through which fuel travels through the nozzle and hence unnecessarily restrict the flow of fuel through the nozzle when a vehicle is being refueled.

OBJECTS AND SUMMARY OF THE INVENTION

An object of a preferred embodiment of the present invention is to provide a novel and unobvious nozzle that prevents excessive dripping from the end of the spout of the nozzle upon removal of the nozzle from a vehicle fuel tank after the refueling process has been completed.

Another object of a preferred embodiment of the present invention is to provide a nozzle that overcomes one or more disadvantages of previously known nozzles.

A further object of a preferred embodiment of the present invention is to provide a nozzle that can be readily and inexpensively manufactured.

Still a further object of a preferred embodiment of the present invention is to reduce the obstructions in the fuel channel or passageway present in prior designs to minimize the obstruction or restriction of the flow of fuel through the nozzle in the refueling process.

Yet still another object of a preferred embodiment of the present invention is to provide a dripless nozzle that does not rely upon a complex valve arrangement to prevent fuel dripping from the end of the spout of the nozzle.

Yet another object of a preferred embodiment of the present invention is to provide a structure that can be readily retrofitted to existing nozzles to prevent dripping from the end of the spout of the nozzle.

Yet still a further object of a preferred embodiment of the present invention is to provide a structure that allows fuel collected in one or more fuel collectors to drain back into the vehicle fuel tank after the flow of fuel has been discontinued but prior to removal of the nozzle from the vehicle fuel tank.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one embodiment of the present invention is directed to a nozzle for dispensing fuel into a vehicle. The nozzle comprises a body portion and a spout extending from the body portion. The spout passes fuel from the body portion to a vehicle. The body portion includes a fuel flow control member for allowing or preventing fuel from passing through the body portion and the spout to the vehicle. The spout has a first portion and a second portion. The first portion of the spout is positioned adjacent the body portion while the second portion of the spout is removed from the body portion. The first portion of the spout has a cross-sectional area greater than the second portion of the spout. A first fuel collection member is provided for collecting fuel remaining in the body portion and the spout after the fuel control member shuts-off the flow of fuel through the body portion and the spout. The first fuel collection member extends into the first portion of the spout and the second portion of the spout.

Another embodiment of the present invention is directed to a nozzle for dispensing fuel into a vehicle. The nozzle includes a body portion and a spout extending from the body portion. The spout passes fuel from the body portion to a vehicle. The body portion includes a fuel flow control member for allowing or preventing fuel from passing through the body portion and the spout into the vehicle. The spout has first and second portions. The first portion of the spout is positioned adjacent the body portion and the second portion of the spout is removed from the body portion. A first fuel collection member is provided for collecting fuel remaining in the body portion and the spout after the fuel control member shuts-off the flow of fuel through the spout. At least a portion of the first fuel collection member extends into the first portion of the spout. A second fuel collection member is provided for collecting fuel remaining in the body portion and the spout after the fuel control member shuts-off the flow of fuel through the spout. The second fuel collection member is located in the second portion of the spout.

A further embodiment of the present invention is directed to a nozzle for dispensing fuel into a vehicle. The nozzle includes a body portion and a spout extending from the body portion. The spout passes fuel from the body portion into a vehicle. The body portion includes a fuel flow control member for allowing or preventing fuel from passing through the body portion and the spout into the vehicle. The spout has first and second portions. The first portion is positioned adjacent the body portion and the second portion is removed from the body portion. The spout has a primary fuel collection area for collecting fuel remaining in the body portion and the spout after the fuel control member shuts-off the flow of fuel through the spout. The spout further includes a secondary fuel collection area for collecting fuel remaining in the body portion and the spout after the fuel control member shuts-off the flow of fuel through the spout.

Still a further embodiment of the present invention is directed to a nozzle for dispensing fuel into a vehicle. The nozzle comprises a body portion and a spout extending from the body portion. The spout passes fuel from the body portion to a vehicle. The body portion includes a fuel flow control member for allowing or preventing fuel from passing through the body portion and the spout into the vehicle. The spout has first and second portions. The first portion of the spout is positioned adjacent the body portion and the second portion of the spout is removed from the body portion. A first fuel collection member is provided for collecting fuel remaining in the body portion and the spout after the fuel control member shuts-off the flow of fuel through the spout. The first fuel collection member is press-fit into the spout.

Yet still a further embodiment of the present invention is directed to a nozzle for dispensing fuel into a vehicle. The nozzle comprises a body portion and a spout extending from the body portion. The spout passes fuel from the body portion to a vehicle. The body portion includes a fuel flow control member for allowing or preventing fuel from passing through the body portion and the spout into the vehicle. The spout has first and second portions. The first portion of the spout is positioned adjacent the body portion and the second portion of the spout is removed from the body portion. A first fuel collection member is provided for collecting fuel remaining in the body portion and the spout after the fuel control member shuts-off the flow of fuel through the spout. The first fuel collection member is fixed relative to the spout such that the first fuel collection member does not move relative to the spout.

Another preferred embodiment of the present invention is directed to a nozzle for dispensing fuel into a vehicle. The nozzle includes a body portion and a spout extending from the body portion. The spout passes fuel from the body portion to a vehicle. The body portion includes a fuel flow control member for allowing or preventing fuel from passing through the body portion and the spout to the vehicle. The spout has an end that is adapted to be inserted into a fuel tank of a vehicle. The end has a lower portion that is closest to the ground when the spout is inserted into the fuel tank of the vehicle. The end further has an upper portion that is further from the ground than the lower portion when the spout is inserted into the fuel tank of the vehicle. A fuel collector collects fuel remaining in the body portion and the spout after the fuel flow control member shuts-off the flow of fuel through the body portion and the spout. The fuel collector has an inclined surface extending between the upper portion of the end of said spout and the lower portion of the end of said spout to allow fuel collected in the fuel collector when the vehicle is being refueled to drain into the fuel tank after the flow control member prevents fuel from passing through the body portion and the spout but prior to removal of the spout from the fuel tank of the vehicle.

A further preferred embodiment of the present invention is directed to a nozzle for dispensing fuel into a vehicle. The nozzle includes a body portion and a spout extending from the body portion. The spout passes fuel from the body portion to a vehicle. The body portion includes a fuel flow control member for allowing or preventing fuel from passing through the body portion and the spout to the vehicle. The spout has an end that is adapted to be inserted into a fuel tank of a vehicle. The end has a lower portion that is closest to the ground when the spout is inserted into the fuel tank of the vehicle. The end further has an upper portion that is further from the ground than the lower portion when the spout is inserted into the fuel tank of the vehicle. A fuel collector collects fuel remaining in the body portion and the spout after the fuel flow control member shuts-off the flow of fuel through the body portion and the spout. The fuel collector has an inner tubular member and an outer tubular member.

Yet a further preferred embodiment of the present invention is directed to a nozzle for dispensing fuel into a vehicle. The nozzle includes a body portion and a spout extending from the body portion. The spout passes fuel from the body portion to a vehicle. The body portion includes a fuel flow control member for allowing or preventing fuel from passing through the body portion and the spout to the vehicle. The spout has an end that is adapted to be inserted into a fuel tank of a vehicle. The end has a lower portion that is closest to the ground when the spout is inserted into the fuel tank of the vehicle. The end further has an upper portion that is further from the ground than the lower portion when the spout is inserted into the fuel tank of the vehicle. A fuel collector has a fuel collection space for collecting fuel remaining in the body portion and the spout after the fuel flow control member shuts-off the flow of fuel through the body portion and the spout. The size of the first collection space varies across the diameter of the spout. The fuel collector is fixed relative to the spout such that the fuel collector does not move relative to the spout.

Still a further preferred embodiment of the present invention is directed to a nozzle for dispensing fuel into a vehicle. The nozzle includes a body portion and a spout extending from the body portion. The spout passes fuel from the body portion to a vehicle. The body portion includes a fuel flow control member for allowing or preventing fuel from passing through the body portion and the spout to the vehicle. The spout has an end that is adapted to be inserted into a fuel tank of a vehicle. A fuel collector collects fuel remaining in the body portion and the spout after the fuel flow control member shuts-off the flow of fuel through the body portion and the spout. The fuel collector is configured to allow fuel collected in the fuel collector when the vehicle is being refueled to drain into the fuel tank of the vehicle after the flow control member prevents fuel from passes through the body portion and the spout but prior to removal of the spout from the fuel tank of the vehicle. The fuel collector has a hollow passageway for permitting fuel to pass through the fuel collector while the vehicle is being refueled. The hollow passageway and the fuel collector have a common central axis.

Yet still another preferred embodiment of the present invention is directed to a nozzle for dispensing fuel into a vehicle. The nozzle includes a body portion and a spout extending from the body portion. The spout passes fuel from the body portion to a vehicle. The body portion includes a fuel flow control member for allowing or preventing fuel from passing through the body portion and the spout to the vehicle. The spout has an end portion that is adapted to be inserted into a fuel tank of a vehicle. The end portion of the spout has a first wall section and a second wall section. The first wall section has a thickness less than the second wall section such that a horizontally extending surface of the second wall section extends inwardly from the first wall section. A fuel collector collects fuel remaining in the body portion and the spout after the fuel flow control member shuts-off the flow of fuel through the body portion and the spout. At least a portion of said fuel collector abuts the first wall section and the horizontally extending surface of the second wall section.

DETAILED DESCRIPTION OF THE PREFERRED EMBODIMENTS OF THE INVENTION

The most preferred forms of the invention will now be described with reference to FIGS. 1-15. The appended claims are not limited to the most preferred forms and no term used herein is to be given a meaning other than its ordinary meaning unless accompanied by a statement that the term "as used herein is defined as follows".

FIGS. 1 Through 6

Figure 1:
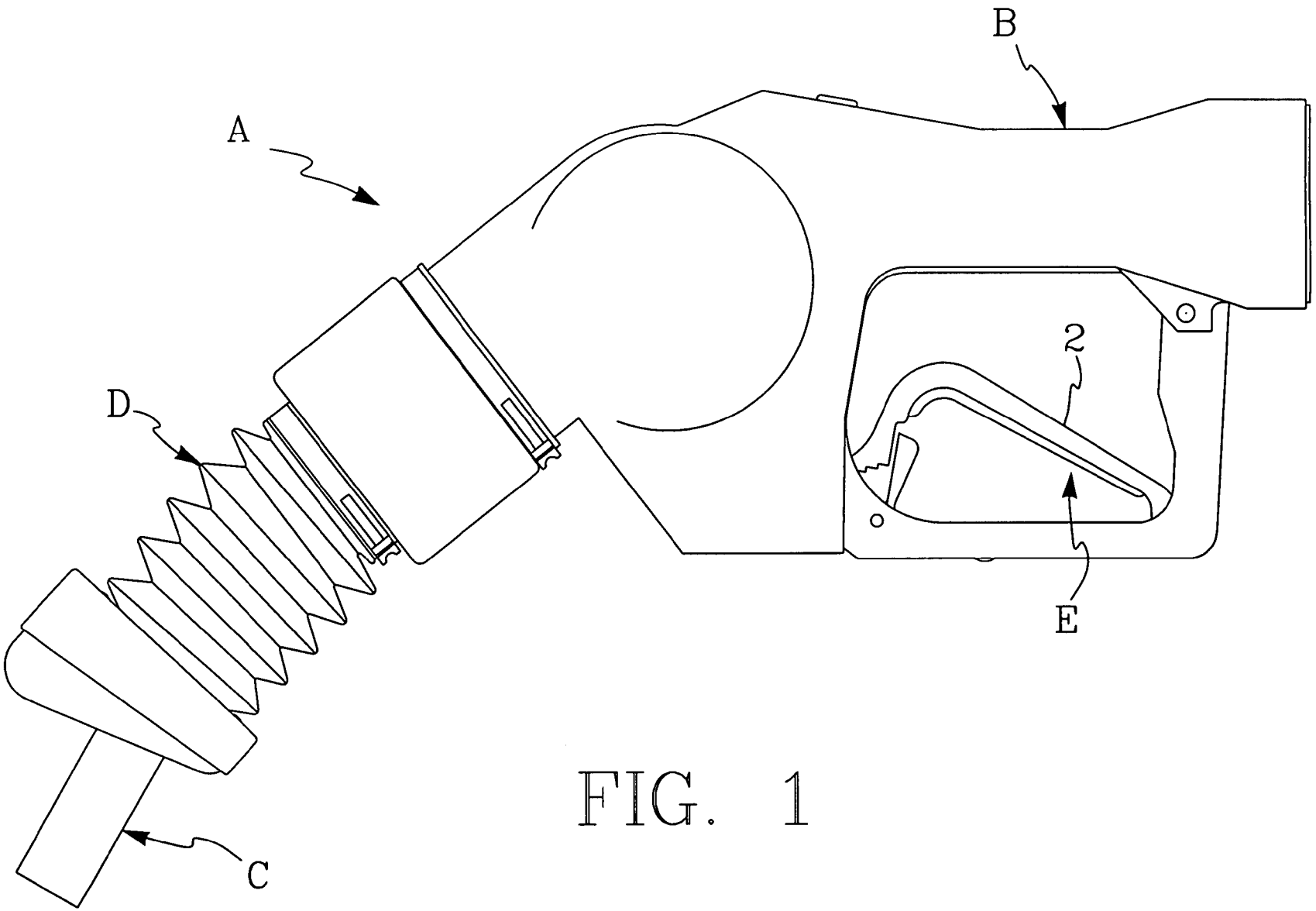
FIG. 1 is an elevational view of a nozzle formed in accordance with a preferred embodiment of the present invention.
Figure 2:
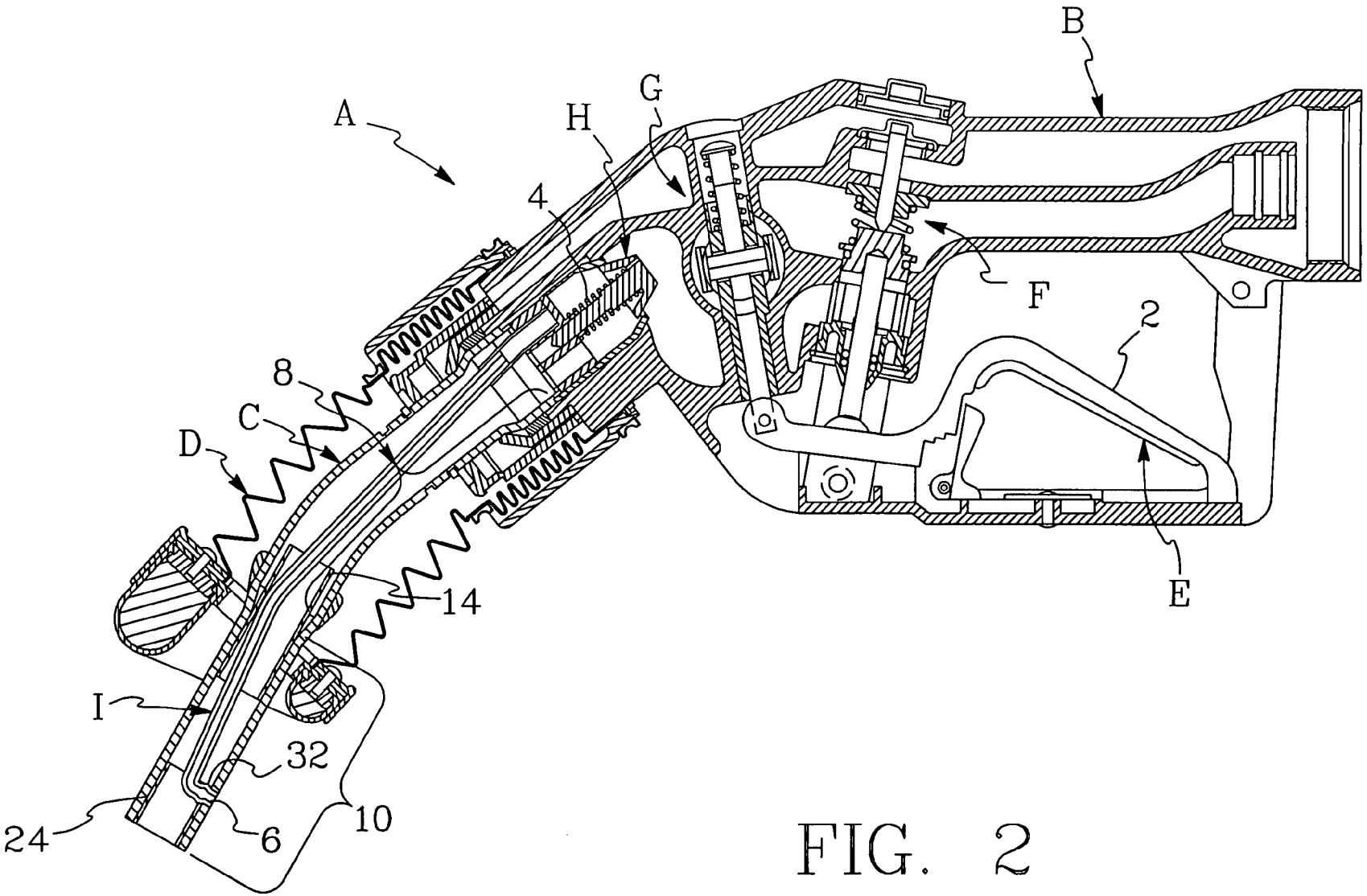
FIG. 2 is a cross-sectional view of the nozzle depicted in FIG. 1.
Figure 3:
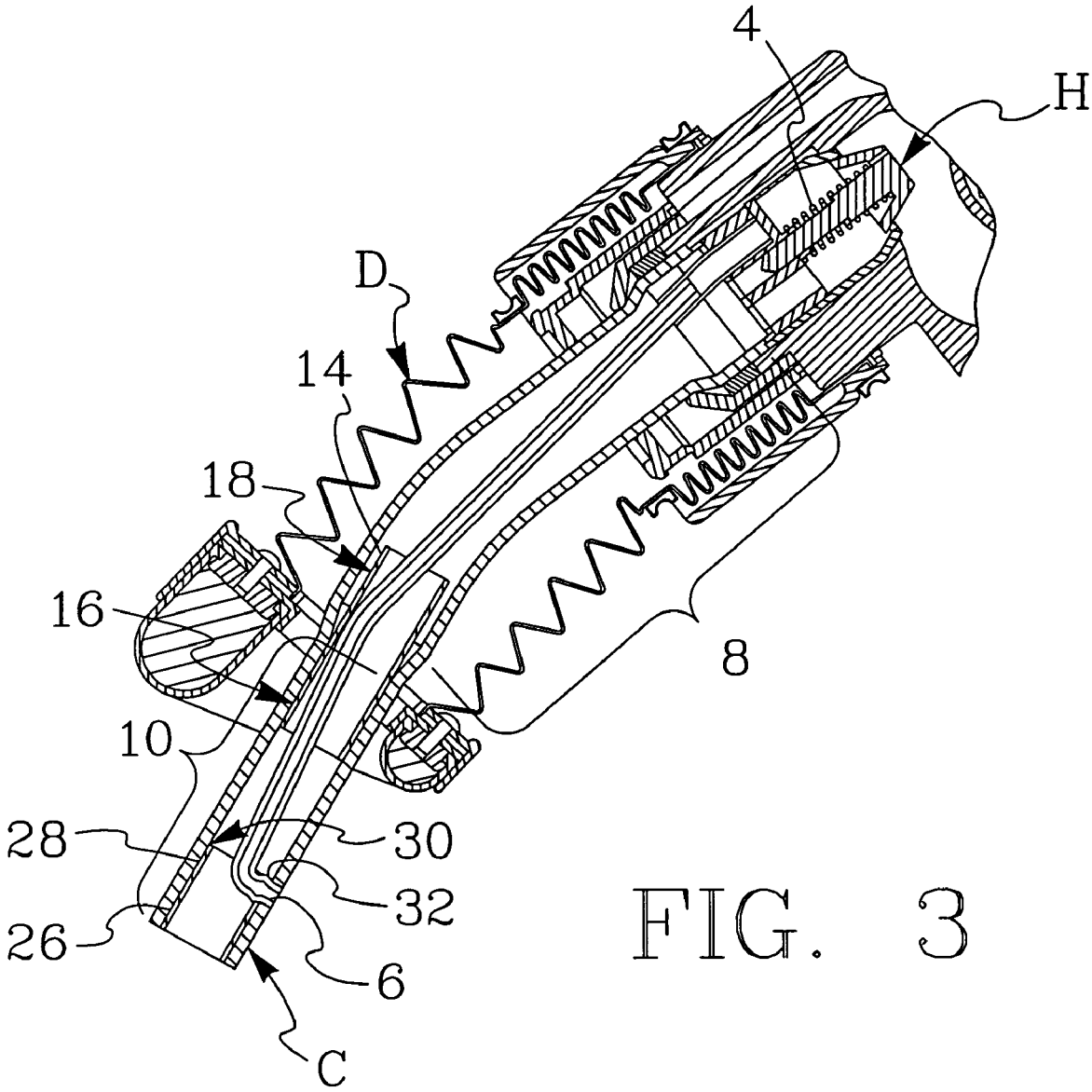
FIG. 3 is an enlarged fragmentary cross-sectional view depicted in FIG. 1.

Referring to FIGS. 1 to 3, a nozzle A is illustrated in one of many possible configurations. While the nozzle A depicted in FIGS. 1 to 3 is of the vapor recovery type, the present invention is in no way limited to vapor recovery nozzles. Rather, the present invention can be used in any form of nozzle.

Referring to FIGS. 1 to 3, nozzle A includes a body portion B, a spout C, a vapor recovery shroud D, trigger mechanism E, a main valve F, a releasable latching mechanism G, a restrictor plug H and a vent tube I. The function of the vapor recovery shroud D and related vapor recovery components are well known and, therefore, will not be descried herein. However, it should be noted that the vapor recovery shroud D and all related vapor recovery components may be omitted in their entirety.

When an individual grabs and raises handle 2 of the trigger mechanism E, the main valve F opens in a well known manner allowing fuel to pass through the body portion B of the nozzle A in the direction of the restrictor plug H. As seen in FIG. 2, the restrictor plug H is biased in a closed position by spring 4. As the fuel flows through the body portion B, the force of the spring 4 is overcome and restrictor plug H moves toward the spout C allowing fuel to flow freely through the spout C and into the fuel tank of a vehicle. Fuel will continue to flow provided the handle is still engaged until such time as the opening 6 of the vent tube I becomes blocked. Upon reaching this condition, the releasable latching mechanism G is activated in a conventional manner to close the main valve F thereby preventing fuel from flowing to the spout C. Once the flow of fuel is discontinued, it is desirable to prevent residual fuel in the body B and spout C from dripping out of the end of the spout C. The preferred form of the invention concerns the spouts and components thereof shown in FIGS. 2 through 15. While FIGS. 2 to 15 illustrate preferred forms, the invention is in no way limited to the forms depicted in these figures.

Figure 4:
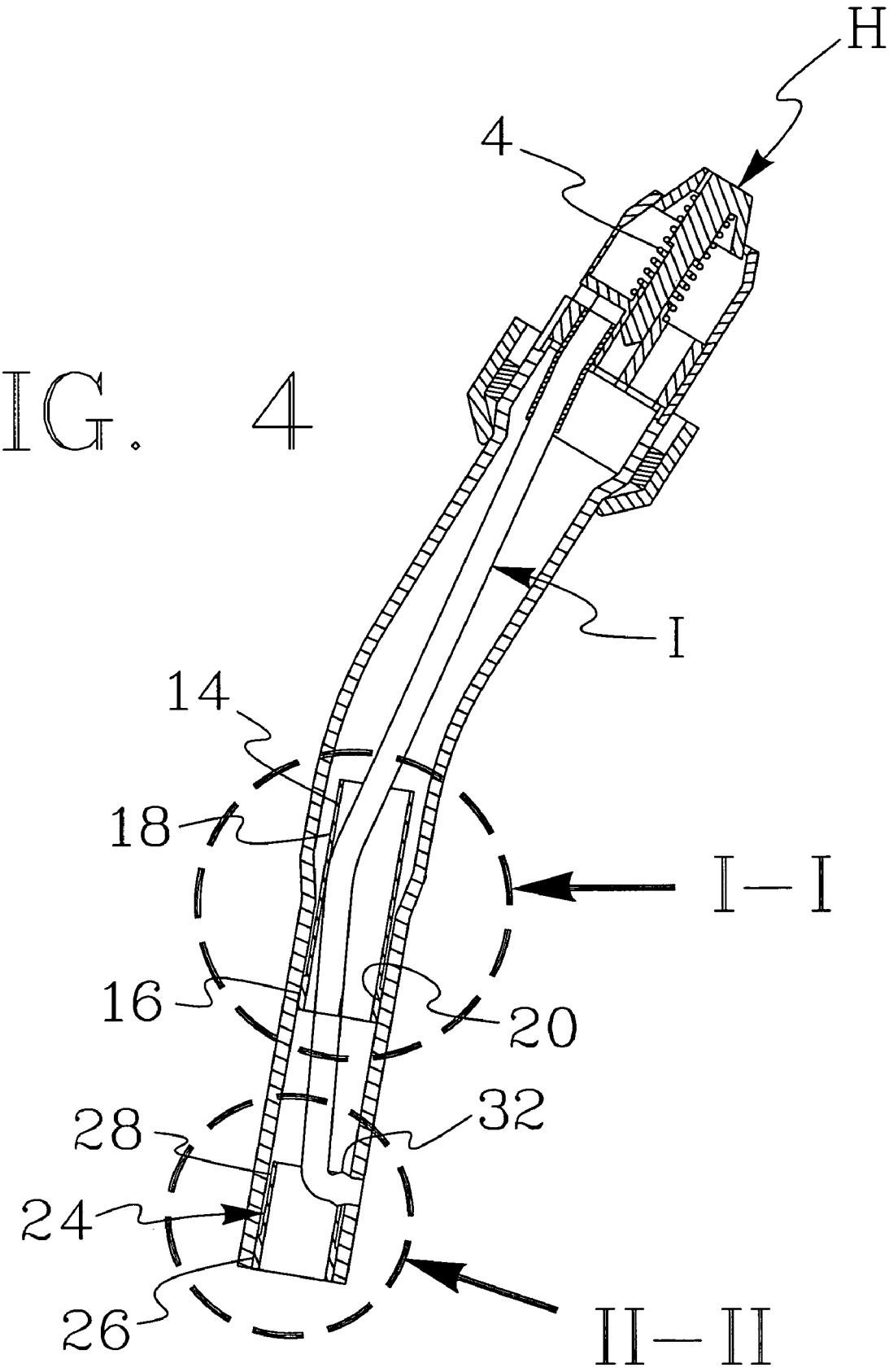
FIG. 4 is a cross-sectional view of a portion of a nozzle formed in accordance with a preferred embodiment of the present invention.

Spout C shown in FIGS. 2, 3 and 4 has a first section 8 and a second section 10. The first section 8 is positioned directly adjacent the body portion B of the nozzle A. The second section 10 extends outwardly from the first section 8 and is removed or spaced from the body portion B, as seen for example in FIG. 2. The cross-sectional area of the first section 8 is greater than the cross-sectional area of the second section 10.

Figure 5:
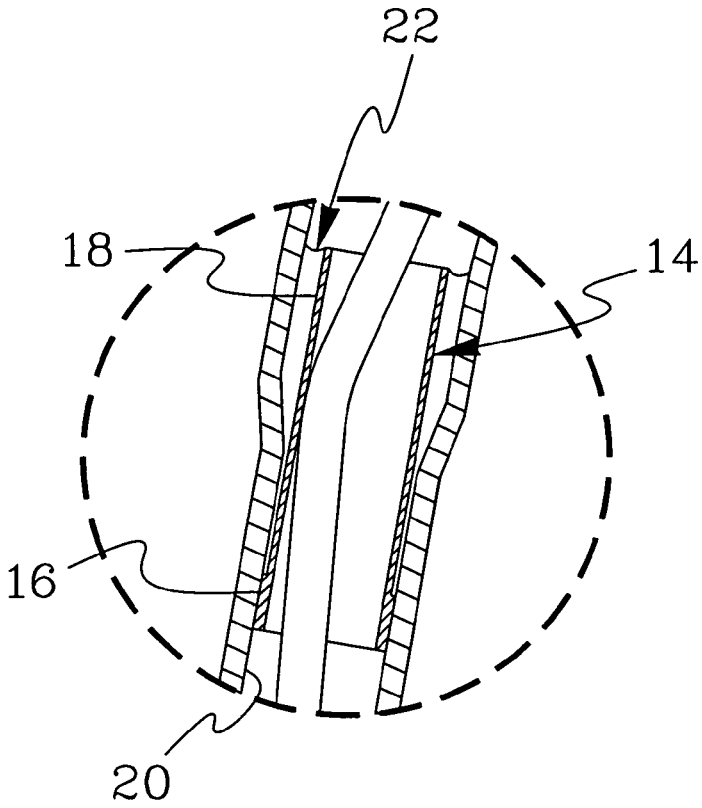
FIG. 5 is an enlarged view of the portion I-I of FIG. 4.
Figure 6:
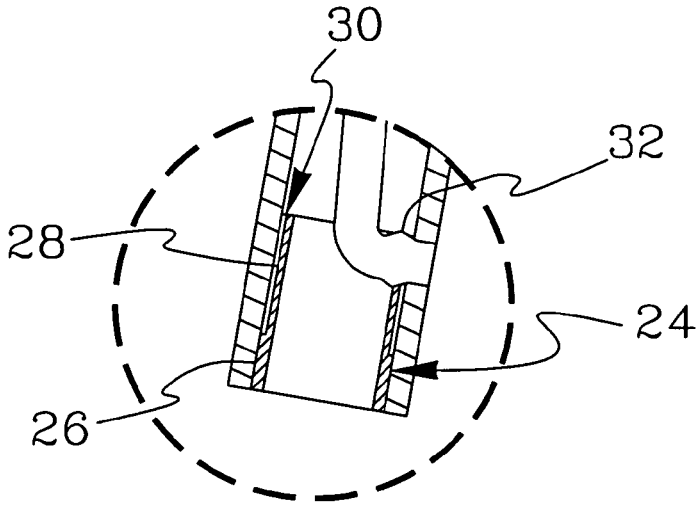
FIG. 6 is an enlarged view of the portion II-II of FIG. 4.

Referring to FIGS. 2, 3, 4 and 5, a first fuel collector 14 is positioned adjacent of the juncture of first section 8 and second section 10 of spout C. More specifically, the first collector 14 preferably extends into both the first section 8 and the second section 10. Preferably, the first collector 14 is substantially cylindrical in shape with a substantially uniform inner diameter. The outer wall of the first collector 14 is preferably stepped at the lowermost end. Specifically, the outer wall of segment 16 extends outwardly a distance greater than the outer wall of segment 18 of the first collector 14 as seen in FIGS. 3, 4 and 5. This allows the outer wall of segment 16 to directly abut the adjacent portion of the inner wall 20 of spout C creating a seal that prevents fuel from passing between the inner wall of the spout C and the outer wall of segment 16.

By spacing the outer wall of segment 18 of the first collector 14 from the inner wall of spout C, an annular collection area 22 is created for collecting residual fuel in the nozzle A after the flow of fuel is discontinued. Fuel is shown in collection area 22 in FIGS. 4 and 5. By locating the first collector 14 adjacent the juncture of the first section 8 and the second section 10, the collection area is relatively large due to the larger cross-sectional area of the first section 8. It should be noted that the first collector is effective at collecting residual fuel due to the fact that the residual fuel tends to travel along the inner wall of the spout C when the nozzle is pointed downwardly. Preferably, the first collector 14 is press fit into the desired position. As such, the first collector 14 is fixed relative to the spout C, i.e., the first collector 14 does not move relative to the spout C. While press fitting is preferred, it will be readily appreciated that other arrangements may be employed. For example, the first collector 14 and the spout C may be formed as one piece.

Referring to FIGS. 2, 3, 4 and 6, a second collector 24 is preferably formed adjacent the end of spout C. Preferably, the second collector 24 is substantially cylindrical in shape with a substantially uniform inner diameter. The outer wall of the second collector 24 is preferably stepped at the lowermost end. Specifically, the outer wall of segment 26 extends outwardly a distance greater than the outer wall of segment 28 of the second collector 24. This allows the outer wall of segment 26 to directly abut the adjacent portion of the inner wall 20 of spout C creating a seal that prevents fuel from passing between the inner wall of the spout C and the outer wall of segment 26. By spacing the outer wall of segment 28 of the second collector 24 from the inner wall of spout C, an annular collection area 30 is created for collecting residual fuel in the nozzle A that is not collected in first collector 14 after the flow of fuel is discontinued through nozzle A. Fuel is shown in collection area 30 in FIGS. 4 and 6.

Referring to FIGS. 2 and 3, segment 28 has an opening formed therein so that the adjacent end of the vent tube I can extend through the second collector 24. An annular rib 32 is formed on the outer surface of the vent tube I adjacent the opening in the segment 28 to prevent fuel from leaking from the collection area 30. Preferably, the second collector 24 is press fit into the desired position. As such, the second collector 24 is fixed relative to the spout C, i.e., the second collector 24 does not move relative to the spout C. While press fitting is preferred, it will be readily appreciated that other arrangements may be employed. For example, the second collector 24 and the spout C may be formed as one piece.

FIGS. 7 Through 15

Referring to FIGS. 7 to 15, spout J is illustrated in one of many possible configurations. It should be noted that spout J can be used with nozzle A illustrated in FIGS. 1 to 3. While the nozzle A depicted in FIGS. 1 to 3 is of the vapor recovery type, spout J is not limited to use in vapor recovery nozzles but rather can be used in any type of nozzle.

Figure 7:
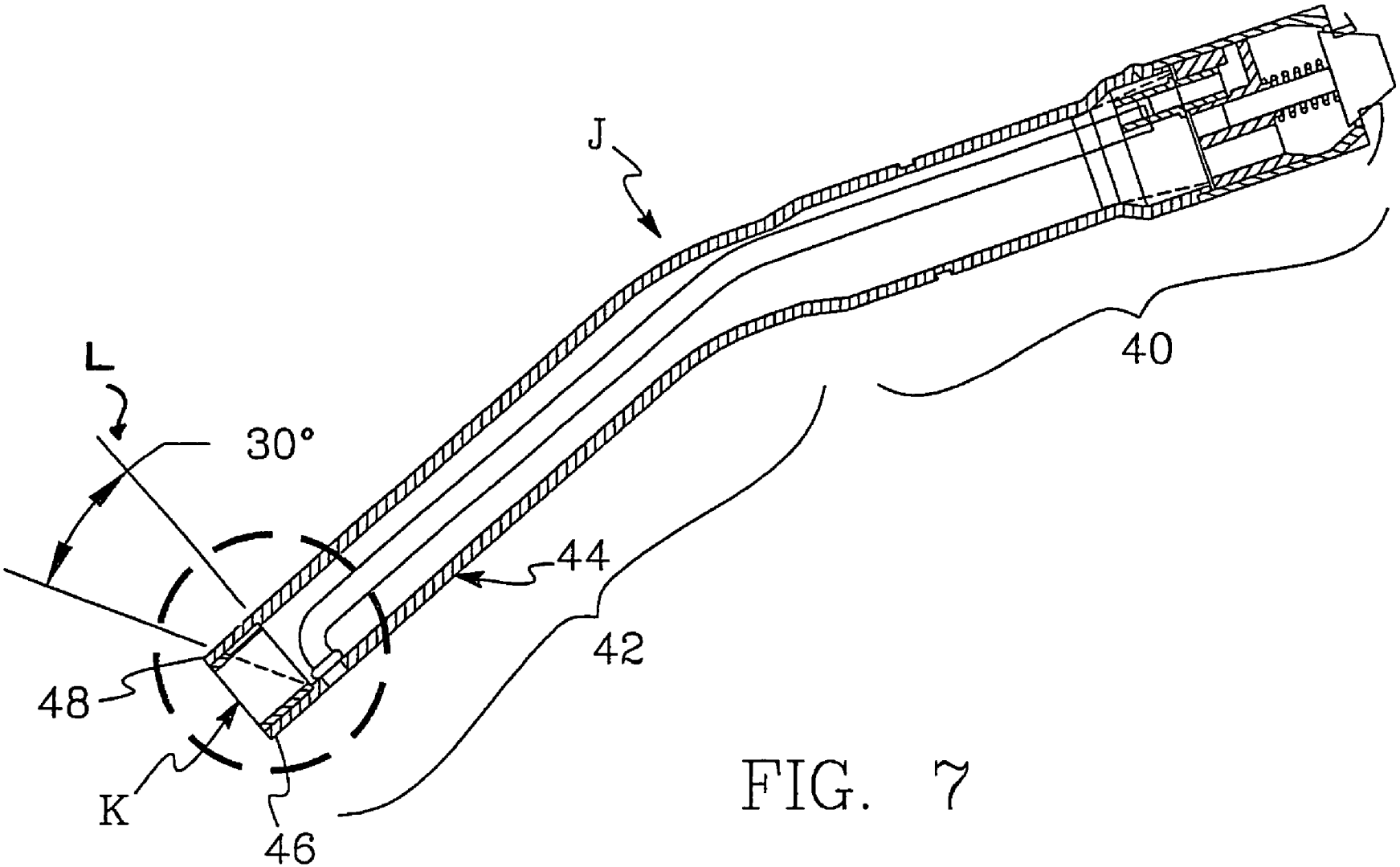
FIG. 7 is a cross-sectional view of a portion of a nozzle formed in accordance with another preferred embodiment of the present invention.
Figure 8:
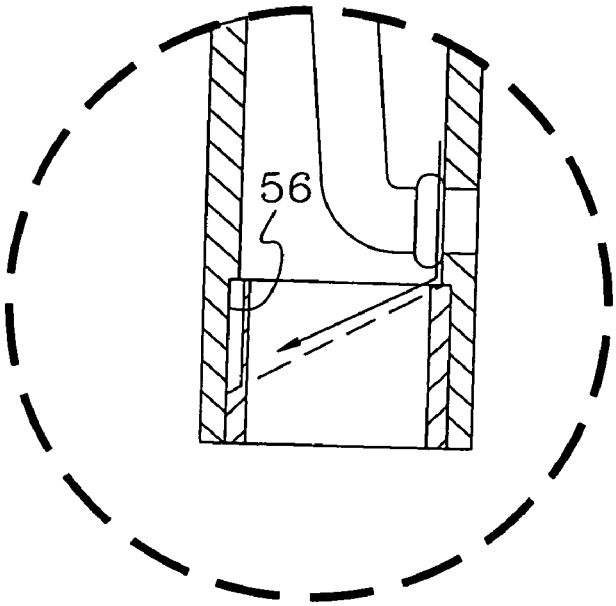
FIG. 8 is an enlarged view of the end of the nozzle portion depicted in FIG. 7 where the end of the nozzle is oriented straight down.
Figure 10:
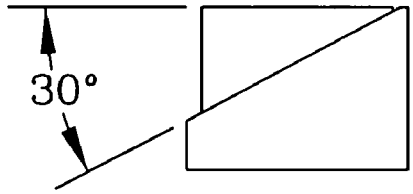
FIG. 10 is a side view of the insert of the nozzle illustrated in FIG. 7.
Figure 9:
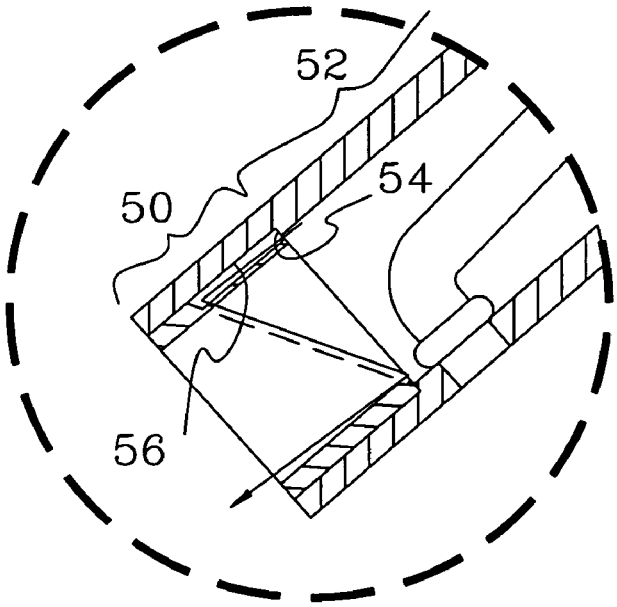
FIG. 9 is an enlarged view of the end of the nozzle portion depicted in FIG. 7 where the nozzle is oriented as it would be if the nozzle were inserted into the filler neck of a fuel tank of a vehicle.
Figure 11:
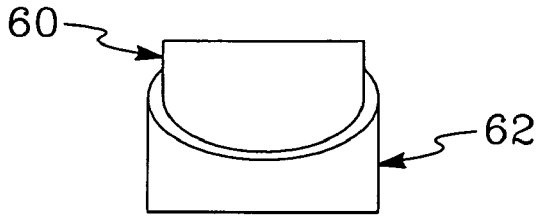
FIG. 11 is a front view of the insert of the nozzle illustrated in FIG. 7.
Figure 12:
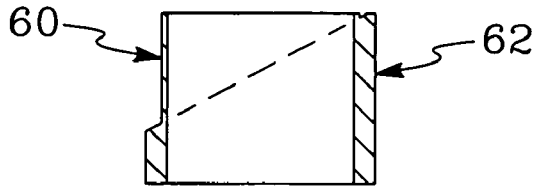
FIG. 12 is a cross-sectional view of the insert of the nozzle illustrated in FIG. 7.
Figure 13:
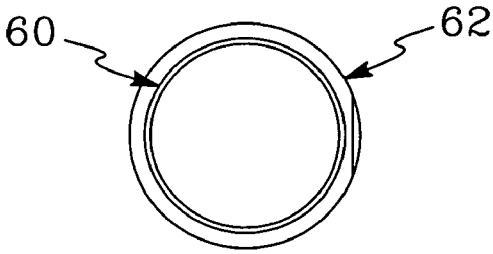
FIG. 13 is a top view of the insert of the nozzle illustrated in FIG. 7.
Figure 14:
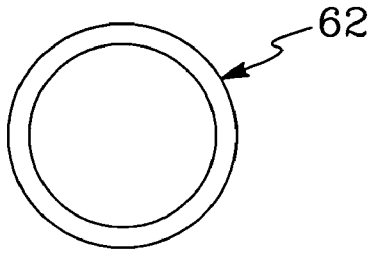
FIG. 14 is a bottom view of the insert of the nozzle illustrated in FIG. 7.
Figure 15:
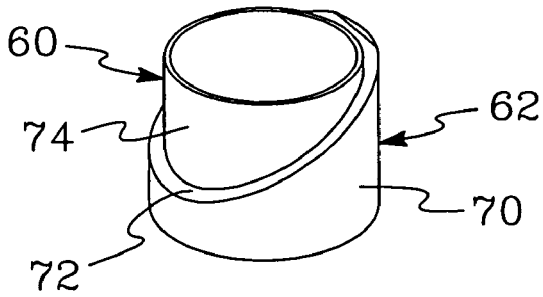
FIG. 15 is a perspective view of the insert of the nozzle illustrated in FIG. 7.

Spout J shown in FIG. 7 has a first section 40 and a second section 42. The first section 40 is positioned directly adjacent the body portion B of the nozzle A. The second section 42 extends outwardly from the first section 40 and is removed or spaced from the body portion B, as seen example in FIG. 7. The cross-sectional area of the first section 40 is greater than the cross-sectional area of the second section 42. As seen in FIGS. 7 to 9, spout J includes an end K that is adapted to be inserted into the filler neck of a fuel tank of a vehicle. Spout J is shown in a preferred orientation in FIG. 7 when the spout J is positioned in the filler neck of a fuel tank of a vehicle. In this orientation, the lower surface 44 of section 42 forms approximately a 41 degree angle with a horizontal plane.

End K has a lower portion 46 that is closest to the ground when the spout J is inserted in to the fuel tank of a vehicle. End K has an upper portion 48 that is further from the ground than the lower portion 46 when the spout J is inserted in to the fuel tank of a vehicle. Referring to FIGS. 8 and 9, end K further includes a first annular wall section 50 and a second annular wall section 52. The first annular wall section 50 forms the terminal end of spout J. The first annular wall section 50 has a wall thickness less than the wall thickness of second annular wall section 52. Second annular wall section 52 includes an annular horizontally extending surface 54 that extends inwardly from the inner surface of first annular wall section 50. This configuration of the first annular wall section 50 and second annular wall section 52 forms a recessed portion 56 in the wall of spout J at the terminal end thereof.

A fuel collector 58 is disposed in spout J adjacent recessed portion 56. Preferably, fuel collector 58 is press fit into recessed portion 56. As such, fuel collector 58 is fixed relative to spout J. While press fitting is the preferred manner of attachment, fuel collector 58 may be attached to the corresponding section of spout J in any suitable manner. It should also be noted that fuel collector 58 can be formed as one piece with spout J. It should be further noted that fuel collector 58 can be used in a spout having a substantially uniform wall thickness, i.e., no recessed end portion. Fuel collector 58 can be the sole fuel collector in spout J. Alternatively, fuel collector 58 can be one of two or more fuel collectors in spout J.

Preferably, fuel collector 58 and end K of spout J are concentric. Referring to FIGS. 10 to 15, fuel collector 58 has an inner tubular member or portion 60 and an outer tubular member or portion 62. Preferably, tubular members 60 and 62 have a circular or substantially circular cross-section. It should be noted that tubular members 60 and 62 may be formed as one piece or two separate pieces. Preferably, annular, outer surface 70 of tubular member 62 engages first annular wall section 50 to form a seal between spout J and fuel collector 58. Tubular member 62 includes an inclined annular surface 72 that extends between upper portion 48 and lower portion 46 of spout J. A fuel collection area is formed by the inclined surface 72 between the inner surface of annular wall section 50 and the exposed, outer surface 74 of tubular member 60 of spout J. The collection area varies in size across the diameter of spout J. Inclined surface 72 preferably forms approximately a thirty degree angle with plane L passing though end K of spout J. Plane L extends perpendicular to the longitudinal axis of end K of spout J. The orientation of the inclined surface 72 at the angle described above, allows the fuel collected by the collector 58 after the shut-off valve has discontinued the flow of fuel through spout J to drain back into the tank of the vehicle prior to removal of the spout J from the fuel tank of the vehicle.

When spout J is removed from the vehicle and oriented in the position illustrated in FIG. 8, fuel remaining in the spout J is trapped in the collection area formed by the collector 58 and the adjacent portions of spout J preventing any significant amount of fuel from spilling into the environment.

As is readily evident from FIGS. 8 and 9, the recessed portion of spout J receiving fuel collector 58 permits the diameter of the passageway 76 of tubular member 60 to be just slightly smaller than the diameter of a conventional spout. Accordingly, fuel collector 58 will not hamper the flow of fuel through the end of spout J during refueling. Preferably, passageway 76 is circular or substantially circular and is centrally disposed in fuel collector 58.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. A nozzle for dispensing fuel into a vehicle, said nozzle comprising:

(a) a body portion and a spout extending from said body portion, said spout passing fuel from said body portion to a vehicle, said body portion including a fuel flow control member for allowing or preventing fuel from passing through said body portion and said spout to the vehicle;

(b) said spout having an end that is adapted to be inserted into a fuel tank of a vehicle, said end having a lower portion that is closest to the ground when said spout is inserted into the fuel tank of the vehicle, said end further having an upper portion that is further from the ground than said lower portion when said spout is inserted into the fuel tank of the vehicle; and, (c) a fuel collector for collecting fuel remaining in said body portion and said spout after said fuel flow control member shuts-off the flow of fuel through said body portion and said spout, said fuel collector having an inclined surface extending between said upper potion of said end of said spout and said lower portion of said end of said spout to allow fuel collected in said fuel collector when the vehicle is being refueled to drain into the fuel tank after said flow control member prevents fuel from passing through said body portion and said spout but prior to removal of said spout from the fuel tank of the vehicle.

2. A nozzle as set forth in claim 1, wherein:

(a) said inclined surface of said fuel collector forms approximately a 30° angle with a horizontal plane extending through said end of said spout.

3. A nozzle as set forth in claim 1, wherein:

(a) said fuel collector is formed as a separate piece from said spout.

4. A nozzle as set forth in claim 2, wherein:

(a) said inclined surface is formed on a tubular member.

5. A nozzle for dispensing fuel into a vehicle, said nozzle comprising:

(a) a body portion and a spout extending from said body portion, said spout passing fuel from said body portion to a vehicle, said body portion including a fuel flow control member for allowing or preventing fuel from passing through said body portion and said spout to the vehicle;

(b) said spout having an end that is adapted to be inserted into a fuel tank of a vehicle, said end having a lower portion that is closest to the ground when said spout is inserted into the fuel tank of the vehicle, said end further having an upper portion that is further from the ground than said lower portion when said spout is inserted into the fuel tank of the vehicle; and, (c) a fuel collector for collecting fuel remaining in said body portion and said spout after said fuel flow control member shuts-off the flow of fuel through said body portion and said spout, said fuel collector having an inner tubular member and an outer tubular member, said outer tubular member has a first portion and a second portion, said first portion extends further into said spout than said second portion.

6. A nozzle as set forth in claim 5, wherein:

(a) said second portion of said outer tubular member is positioned adjacent said lower portion of said end of said spout and said first portion of said outer tubular member is positioned adjacent said upper portion of said end of said spout.

7. A nozzle as set forth in claim 5, wherein:

(a) said inner tubular member and said outer tubular member each have a substantially circular cross-section.

8. A nozzle for dispensing fuel into a vehicle, said nozzle comprising:

(a) a body portion and a spout extending from said body portion, said spout passing fuel from said body portion to a vehicle, said body portion including a fuel flow control member for allowing or preventing fuel from passing through said body portion and said spout to the vehicle;

(b) said spout having an end that is adapted to be inserted into a fuel tank of a vehicle, said end having a lower portion that is closest to the ground when said spout is inserted into the fuel tank of the vehicle, said end further having an upper portion that is further from the ground than said lower portion when said spout is inserted into the fuel tank of the vehicle; and, (c) a fuel collector having a fuel collection space for collecting fuel remaining in said body portion and said spout after said fuel flow control member shuts-off the flow of fuel through said body portion and said spout, the size of said fuel collection space varies across the diameter of said spout, said fuel collector being fixed relative to said spout such that said fuel collector does not move relative to said spout, said fuel collector has at least one tubular member, said at least one tubular member has an inclined surface to vary the size of said fuel collection space across the diameter of said spout.

9. A nozzle as set forth in claim 8, wherein:

(a) said fuel collector and said end of said spout are concentric.

10. A nozzle as set forth in claim 8, wherein:

(a) said fuel collector has at least one tubular member.

11. A nozzle for dispensing fuel into a vehicle, said nozzle comprising:

(a) a body portion and a spout extending from said body portion, said spout passing fuel from said body portion to a vehicle, said body portion including a fuel flow control member for allowing or preventing fuel from passing through said body portion and said spout to the vehicle;

(b) said spout having an end that is adapted to be inserted into a fuel tank of a vehicle; and, (c) a fuel collector for collecting fuel remaining in said body portion and said spout after said fuel flow control member shuts-off the flow of fuel through said body portion and said spout, said fuel collector being configured to allow fuel collected in said fuel collector when the vehicle is being refueled to drain into the fuel tank of the vehicle after said flow control member prevents fuel from passing through said body portion and said spout but prior to removal of said spout from the fuel tank of the vehicle, said fuel collector having a hollow passageway for permitting fuel to pass through said fuel collector while the vehicle is being refueled, said hollow passageway and said fuel collector have a common central axis.

12. A nozzle as set forth in claim 11, wherein:

(a) said fuel collector is formed as a separate piece from said nozzle.

13. A nozzle as set forth in claim 12, wherein:

(a) said fuel collector is disposed in said end of said spout.

14. A nozzle as set forth in claim 11, wherein:

(a) said end of said spout includes a first wall section and a second wall section, said first wall section has a thickness less than said second wall section such that a horizontally extending surface of said second wall section extends inwardly from said first wall section, said fuel collector abuts at least one of said first wall section and said horizontally extending surface of said second wall section.

15. A nozzle for dispensing fuel into a vehicle, said nozzle comprising:

(a) a body portion and a spout extending from said body portion, said spout passing fuel from said body portion to a vehicle, said body portion including a fuel flow control member for allowing or preventing fuel from passing through said body portion and said spout to the vehicle;

(b) said spout having an end portion that is adapted to be inserted into a fuel tank of a vehicle, said end portion of said spout having a first wall section and a second wall section, said first wall section having a thickness less than said second wall section such that a horizontally extending surface of said second wall section extends inwardly from said first wall section; and, (c) a fuel collector for collecting fuel remaining in said body portion and said spout after said fuel flow control member shuts-off the flow of fuel through said body portion and said spout, at least a portion of said fuel collector abuts said first wall section and said horizontally extending surface of said second wall section.

16. A nozzle as set forth in claim 15, wherein:

(a) said fuel collector is press fit into said spout.

17. A nozzle as set forth in claim 15, wherein:

(a) said fuel collector has a collection space that varies in size across the diameter of said spout.

18. A nozzle as set forth in claim 15, wherein:

(a) said fuel collector includes an inner tubular member and an outer tubular member, said outer tubular member has an inclined surface.

* * * * *